United States Patent [19]

Klipsch et al.

[11] 4,387,786

[45] Jun. 14, 1983

[54] ANECHOIC CHAMBER ARRANGEMENT

[75] Inventors: Paul W. Klipsch; James R. Hunter, both of Hope, Ark.

[73] Assignee: Klipsch and Associates, Inc., Hope, Ark.

[21] Appl. No.: 271,514

[22] Filed: Jun. 8, 1981

[51] Int. Cl.[3] ..... H05K 5/00; E04B 1/82; A47B 81/06

[52] U.S. Cl. ..... 181/150; 52/65; 181/198; 181/295

[58] Field of Search ..... 181/30, 146, 150, 151, 181/198, 199, 295; 52/7, 31, 32, 65; 312/242

[56] References Cited

U.S. PATENT DOCUMENTS

| | | | |
|---|---|---|---|
| 1,559,739 | 11/1925 | Brown | 52/7 |
| 2,451,283 | 10/1948 | Gannett et al. | 52/7 |
| 2,567,070 | 9/1951 | Hjartsater | 181/30 |
| 3,964,571 | 6/1976 | Snell | 181/150 |

OTHER PUBLICATIONS

"Acoustic Laboratory", Mar. 1946, *Electronic Industry* p. 78.

*Primary Examiner*—Thomas H. Tarcza
*Attorney, Agent, or Firm*—Wood, Herron & Evans

[57] ABSTRACT

An anechoic chamber having a rotatable corner in the nature of a rotating door which permits the selection of a desired one of four right angle corners to be introduced into operative engagement with the room. In the use of the anechoic chamber, with a selected corner in position facing into the chamber, a sound seal is provided about the periphery of the frame of the rotating door. The walls of the anechoic chamber are covered by sound absorbent material, and one of the four corners which may be positioned in the chamber through rotation of the rotating door contains surfaces similarly covered by sound absorbent material. Another of the four corners is a trihedral corner including a base, or floor, for supporting a corner speaker.

4 Claims, 7 Drawing Figures

ANECHOIC CHAMBER ARRANGEMENT

DESCRIPTION OF THE INVENTION

This invention relates generally to an anechoic chamber and more particularly, concerns such a chamber which may be altered for testing different types, or different operational modes, of sound generating devices.

The testing of loudspeakers is most often conducted in either a live room environment or an anechoic chamber. In order to take acoustical measurements, the anechoic chamber is preferred due to accuracy and repeatability of measurements. An anechoic chamber provides more accurate acoustical readings than a live room since echoes are substantially eliminated and a pickup device, such as a microphone, to a large degree picks up only direct sound from the loudspeaker. The anechoic chamber also provides more repeatable measurements since there are no movable objects, such as furniture or the like, as found in a live room. The positions of such movable objects in a live room may be varied from time to time between measurements, thereby precluding repeatability.

In a conventional anechoic chamber, all interior surfaces are largely non-reflective, and a loudspeaker under test is located within the chamber, generally spaced apart from the non-reflective inside walls. Such an anechoic chamber is not suitable for testing corner speakers nor for evaluating loudspeakers which are adaptable for operation in a variety of locations such as in a corner or against a wall.

The low frequency response of a corner speaker is dependent upon a trihedral corner, typically two walls and the floor of a room, in normal operation. In testing a corner loudspeaker in an anechoic chamber, placing the speaker in a free standing position interior of the chamber walls produces inaccurate frequency response measurements since the trihedral corner, essential to the proper functioning of the speaker, is absent. An alternative means of testing a corner speaker in an anechoic chamber has been to provide a false corner into which the speaker is placed, and the false corner and the speaker are placed in a free standing position in the interior of the anechoic chamber for test measurements. The backsides, or outside surfaces, of such a false corner, however, introduce extra reflective surfaces which dilute the anechoic properties of the room. Further, variations in the positioning of such a false corner leads to diminished repeatability of acoustic measurements.

It is consequently an object of the present invention to provide an anechoic chamber arrangement which permits the accurate, repeatable testing of corner speakers.

It is a further object of the invention to provide such an anechoic chamber arrangement that may function as a conventional anechoic chamber or as a chamber especially suited for the testing of corner speakers.

It is a still further object of the invention to provide such an anechoic chamber arrangement in which other modes of speaker testing may be provided.

It is a subsidiary object of the invention to provide such an anechoic chamber which facilitates the placement and removal of speakers in a test position in an anechoic chamber.

Other objects and advantages of the invention will become apparent upon reading the following detailed description and upon reference to the drawings, in which.

Figure 1:
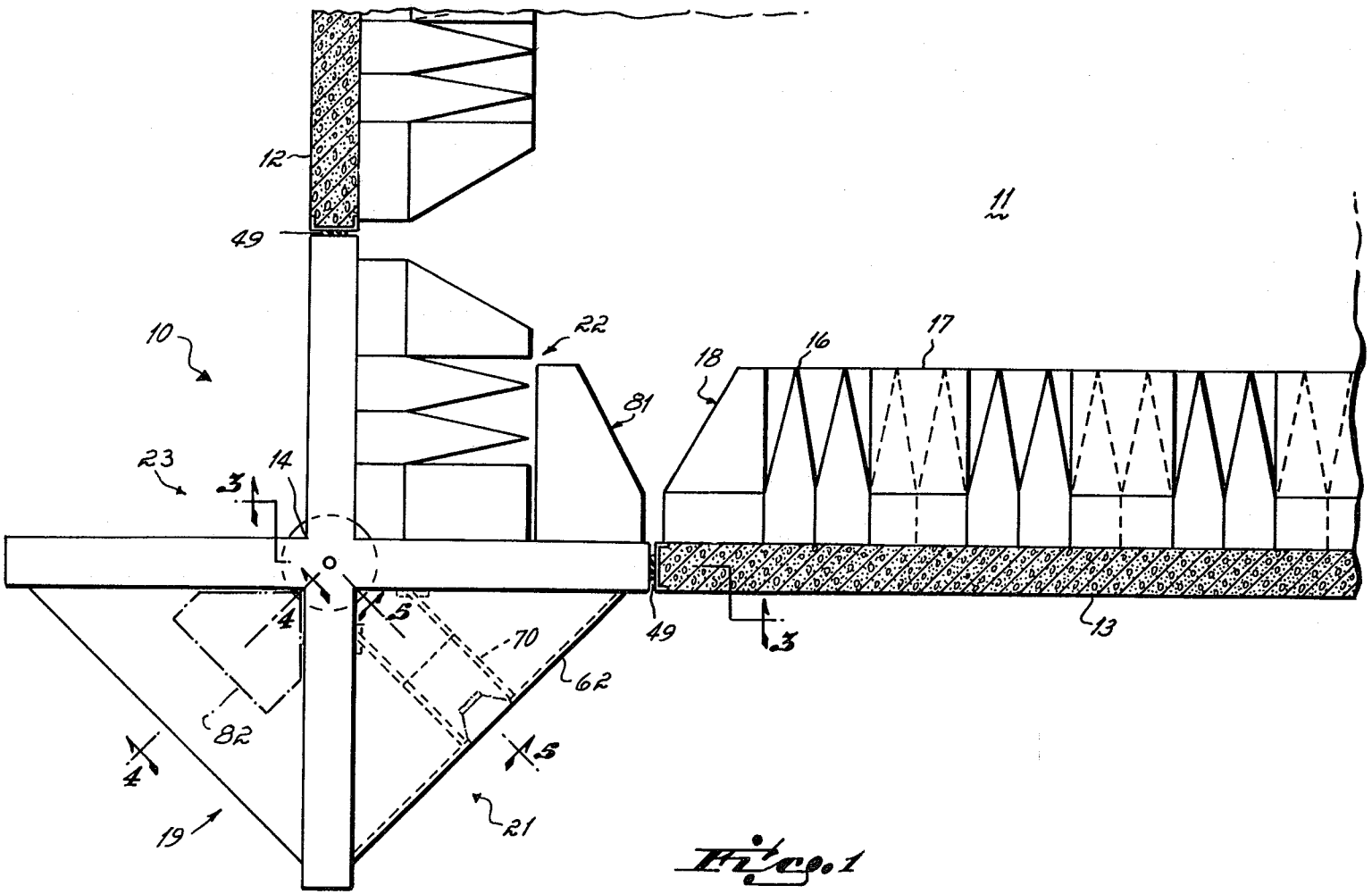
FIG. 1 is a top plan view of a portion of an anechoic chamber arrangement in accordance with the present invention.

In meeting the objects of the present invention, there is described herein an anechoic chamber arrangement which includes an enclosed chamber, two walls of which define an open corner, and a rotatable door having several vertical wall vanes rotatable about a vertical axis, defining several corners, a selected one of which may be turned into cooperative relationship with the anechoic chamber.

In meeting further objects of the invention, one of the rotatable corners has its interior surfaces covered by sound absorbent material to be compatible with the interior of the anechoic chamber, and another rotatable corner is provided with a platform to define a trihedral corner adapted for the testing of a corner speaker. In accordance with a subsidiary object of the invention, a loudspeaker may be positioned in a rotatable corner outside the anechoic chamber and subsequently rotated into position for testing in the chamber.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

The types of sound generating devices which may be tested in an anechoic chamber arrangement as described shall be generally characterized herein as speakers or loudspeakers. However, a loudspeaker should be considered to encompass a system comprising a driving motor or "raw speaker" with its associated box, baffle, horn, or other device for coupling the diaphragm of the motor to the air. A driving motor should be construed to mean a voice coil, magnet structure and diaphragm, piezoelectric motor with diaphragm, or an electrostatic actuator with a membrane or diaphragm. The term loudspeaker should also be construed to include a system of two or more speakers as defined above.

With initial reference to FIG. 1, an anechoic chamber arrangement 10 includes an anechoic chamber 11 having an acoustically insulated floor, ceiling and four walls. Two of the walls, 12 and 13, do not fully meet but rather extend toward one another to define an open corner in which a rotatable door, indicated generally as 14, is located. In the illustrated form, the room construction of the anechoic chamber is more or less conventional. A single wall construction is utilized with a concrete slab foundation poured above a concrete "beam" lattice, which is in turn supported by concrete pillars of varying depths.

The walls, such as 12 and 13, are constructed of concrete and may comprise blocks having filled cavities and including reinforcing bars (not shown). The walls terminate at their upper portion with hollow core concrete slabs to form a roof topped with poured concrete, fiberglass insulation, and a steel cap.

Each of the walls, such as 12 and 13, receive a sound absorbing wedge treatment system. Each of the wedges is constructed of a high density fiberglass protected with hardware cloth. The wedge geometry on the walls is substantially conventional. The basic elements of the wedge system are two-pointed wedge assemblies, with each double wedge mounted on a network of steel tracks with the wedge points oriented perpendicularly with respect to those of adjacent wedges. For example, an uppermost pair of wedges has edges such as 16 which are oriented vertically. The adjacent uppermost pair of wedges has a pair of horizontally oriented edges, such as 17.

This pattern is broken only by those wall wedges which border the rotatable door 14. In this instance, all wedge points are oriented horizontally to provide a door area with a "window" of maximum area into the chamber. For the same reason, those wedges on the walls bordering the open corner are beveled as shown at 18.

The door 14 located in the open corner is a four vaned turnstile door rotatable on a vertical axis. A selectable one of four corners defined by the door may at any one time be positioned into operative engagement with the room 11. A first corner 19 is a trihedral corner for the testing of loudspeakers designed for use in a corner. The door corner 21 provides a flat baffle. The corner 22 contains the sound absorbing material compatible with that of the walls. With the door 14 in the position illustrated in FIG. 1, with the corner 22 in operative position in the room 11, the chamber is typically anechoic. The corner 23 provides a dihedral corner in which special constructions may be devised.

Figure 2:
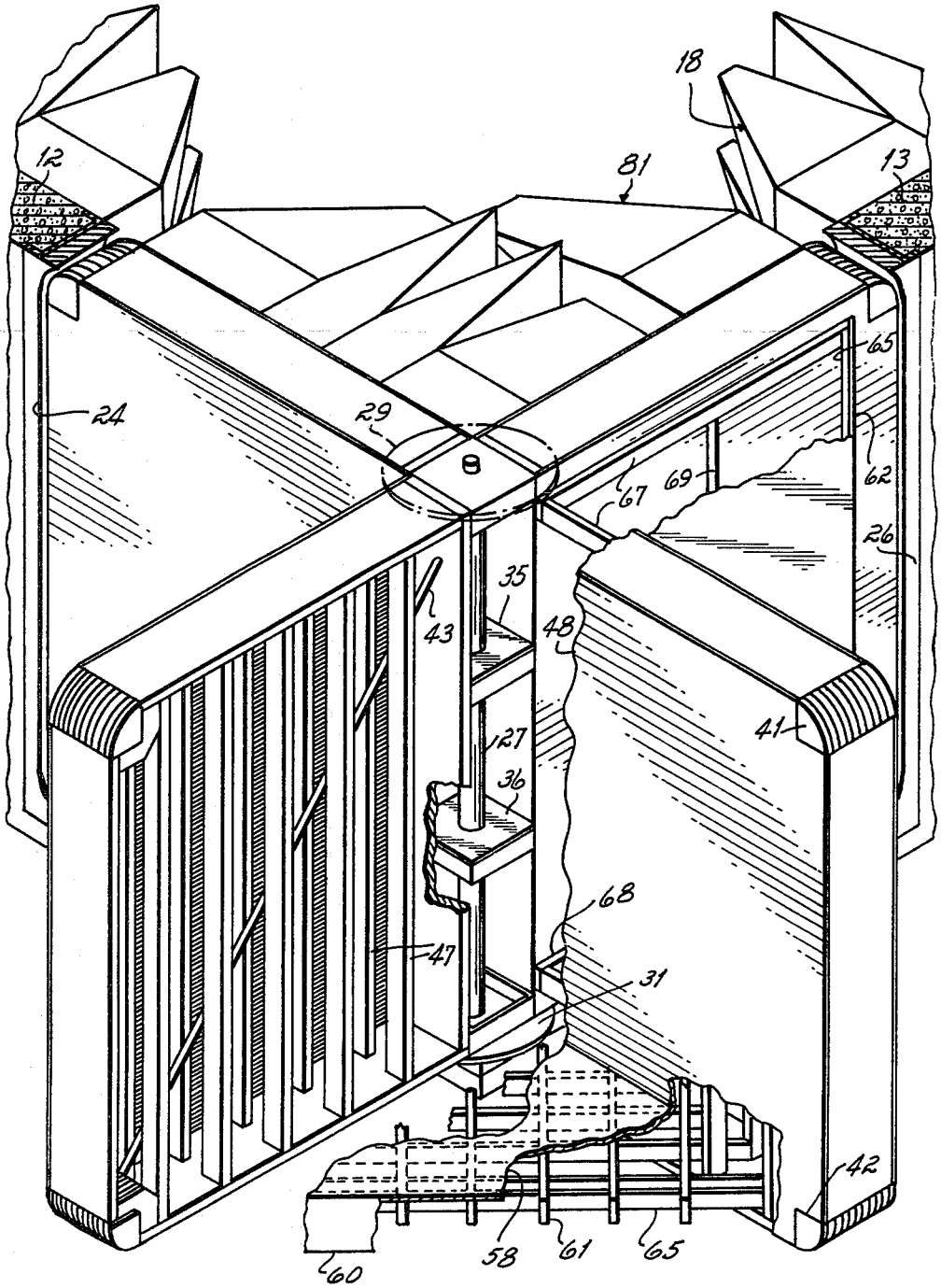
FIG. 2 is a perspective view, with portions removed, of the rotatable door of the chamber arrangement of FIG. 1.
Figure 3:
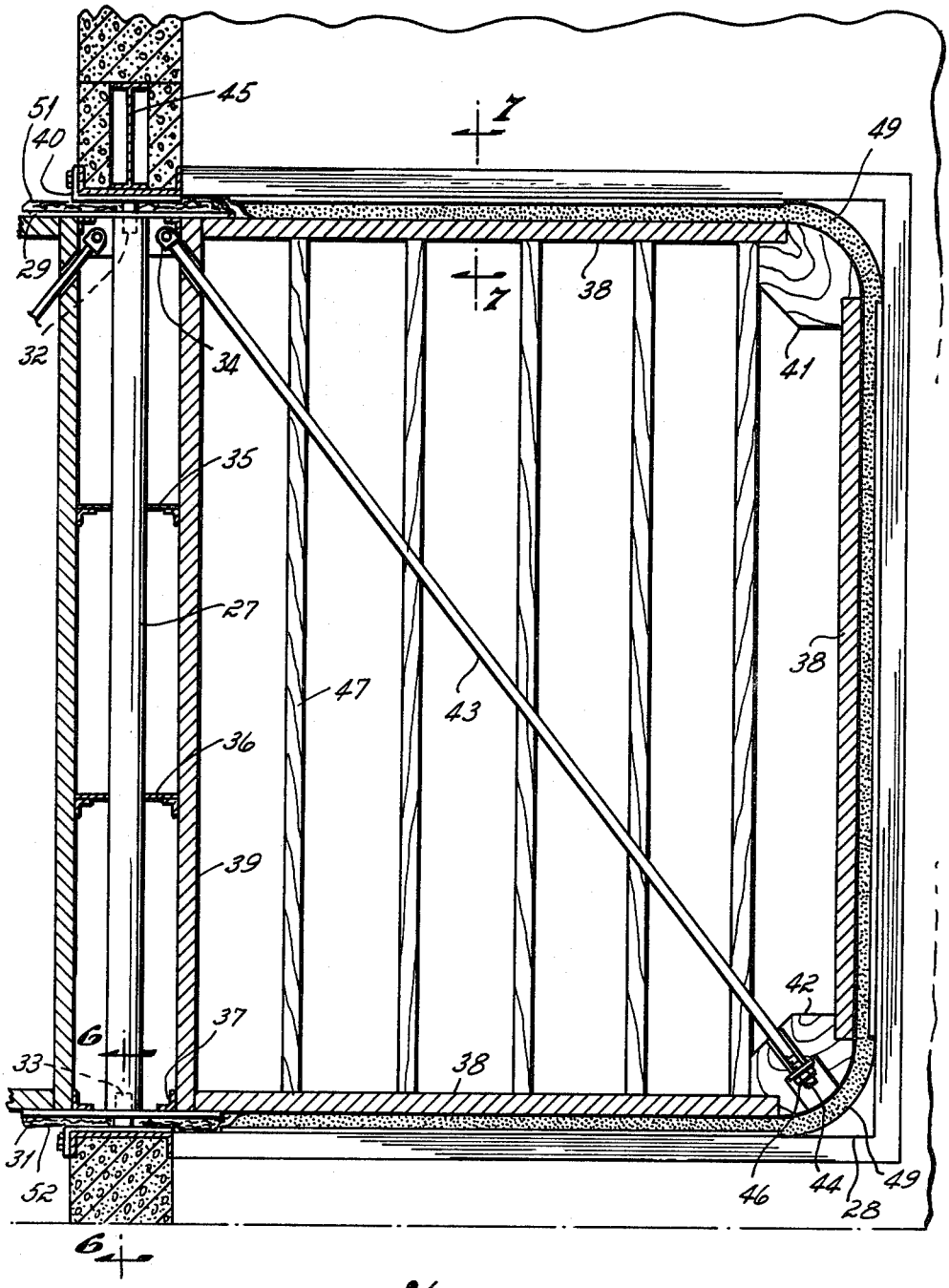
FIG. 3 is a sectional view of a portion of the door of FIG. 1 taken along the line 3—3 in that Figure.
Figure 4:
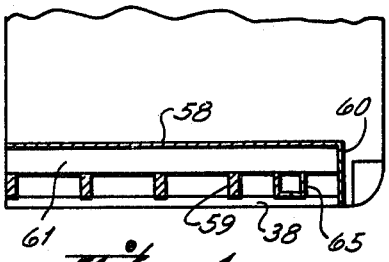
FIG. 4 is a sectional view of another portion of the door taken along the line 4—4 of FIG. 1.

With reference now in particular to FIGS. 2 and 3, the construction of the rotating door 14 and its interface with the walls 12 and 13 shall be described in more detail. The door casement is established by steel channel members 24 and 26, defining C-shaped openings in the walls 12 and 13, respectively. The channel members are welded together above and below the axis of rotation of the door, an axle 27. Each of the four casement corners have quarter-round steel plate inserts, such as 28, welded therein to provide a smooth transition from vertical to horizontal and providing a suitable mounting surface for pneumatic door seals, to be described in more detail hereinafter.

Figure 6:
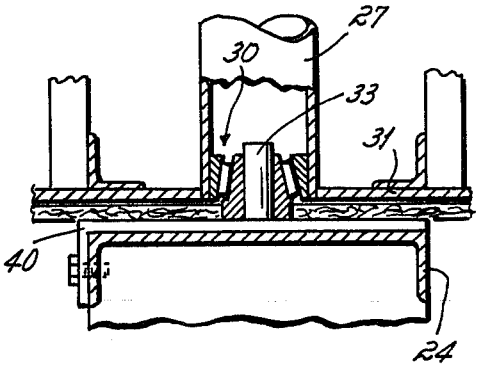
FIG. 6 is a sectional view of a portion of the base of the axle of the door taken along the line 6—6 in FIG. 3.

In order to permit rotation of the door 14, the door includes the axle 27, which is a steel pipe. Welded to each end of the axle pipe are steel discs 29 and 31. Received in these discs, and in the upper and lower portions of the axle 27, are an upper stub axle 32 and a lower stub axle 33, each having associated tapered roller bearings 30 in the axle pipe (FIG. 6). The stub axles 32, 33 terminate at the top and bottom of the casement, respectively, on plates 40 which are bolted to the casement members 24, 26 at their weld connection areas. The casement-axle assembly are separable if necessary, by unfastening the bolts. The weight of the walls and roof above the open corner may be removed from the door axle. In order to do this, a long beam 45 is welded to the top of each of the casement members 24, 26 with the remaining beam length resting on the blocks of the wall in a cantilever arrangement.

In order to attach the four vanes of the rotating door to the axle assembly, four square mounting bracket assemblies 34–37 are rigidly attached to the axle 27. The upper bracket assembly 34 and the lower bracket assembly 37 cooperate with the upper and lower discs 29 and 31, respectively in effecting attachment to the axle 27. The perimeter of each wall vane is framed with a hard wood such as mahogany. The perimeter is defined by outer frame portions 38 and an inner frame portion 39. The interior frame portion 39, near the axle 27, is attached to vertical flanges of the bracket assemblies 34–37. The top and bottom corners 41 and 42 of each vane are radiused wood corners. In order to prevent sagging of the wall vanes, the lower outside corners 42 of the vanes are each tensioned with a steel rod 43 running diagonally to an attachment point at the top of the axle. The lower end 44 of each rod 43 is threadedly received in a nut 46 biased against the corner 42. The cavity within which the nut and rod end are received may be plugged with a wooden plug. The plug can be removed at a later time to provide access to the nut for further tensioning of the rod 43 to restore the squareness of the door vane should it become necessary.

Each side of each wall is independently studded with studs 47. Paneling 48 covers both sides of each door vane, with the interior preferably tightly stuffed with fiberglass (not shown). All four of the wall vanes are substantially identical in construction.

In order to seal the door vanes when they are in operative position, pneumatically inflatable rubber "hoses" 49 are provided, lying along each of the two C-shaped casement sections. Each inflatable hose terminates slightly spaced apart from the rotating plates 29, 31. Heavy felt washers 51, 52 complete the sealing at the axle, above and below the discs 29, 31, respectively.

Figure 7:
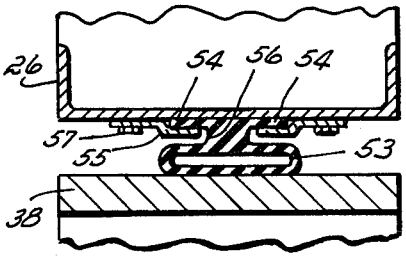
FIG. 7 is a sectional view of a portion of the door and door casing showing the sealing means therebetween, taken along the line 7—7 of FIG. 3.

Each inflatable hose 49 includes an inflatable portion 53 (FIG. 7) which, when inflated, contacts the door casing 38 and further includes a flat portion 54 running along the casement 26. The flat portion 54 and the inflatable portion 53 are connected by a neck 56. The inflatable hose 49 is attached to the door casing 26 by bolts 57 which secure elongated plates 55 running along the casing to hold the hose in position. When the rotatable door 14 is indexed into a selected test position, the hoses are inflated, and due to the large surface area in contact, the seals allow virtually no further door motion.

As can be seen, the wall vane construction provides four distinct corners which may be introduced into the chamber 11. The trihedral corner 19 for testing of corner-placement loudspeakers comprises a floor panel 58 with an optional front apron 60 mounted between the two adjacent wall vanes. Support for the floor is provided by two mutually perpendicular layers of floor joists. The lower layer of joists, such as 59, is supported by the bottom wooden frame members 38 of the adjacent wall vanes. The outermost joist in this layer is preferably a steel channel 65. The upper layer of joists, such as 61, extends perpendicularly beyond the lower steel joist 65 in a cantilever arrangement to provide the required depth of floor for testing various sizes of corner loudspeakers. Except in the case of extremely large speakers, this trihedral corner provides one-eighth space loading.

Quarter space loading is provided in the corner section 23. To accomplish quarter space loading in this quadrant of the door, a speaker is hung in the vertical center of the corner.

Figure 5:
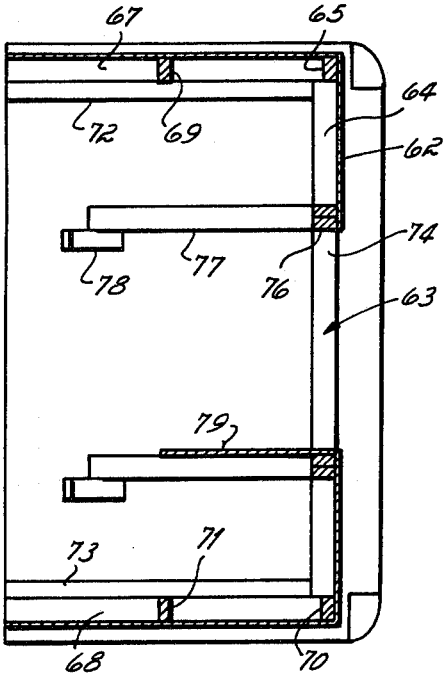
FIG. 5 is a sectional view of another portion of the door taken along the line 5—5 of FIG. 1.

In the corner section 21 (FIGS. 1 and 5), provision is made for half space loading of individual drivers and smaller speaker systems. A baffle wall 62 with a "window" 63 is located as near to the outer edge of the door vanes as is practical. This baffle wall is heavily braced by a series of vertical studs 64 extending between an upper stud 65 and a lower stud 70, each of which extend across the front of the corner 21. The upper stud 65 defines a triangle in cooperation with a pair of horizontal studs 67 attached along each of the two wall vane faces of the corner. A similar pair of lower studs 68 are attached along the lower edges of the side walls to cooperate with the stud 66 to define a triangle. Additional support studs 69 and 71 are attached between the studs 67 and 68, respectively; and further, upper and lower support studs 72, 73 extend outwardly from the corner in a direction to bisect the 90° angle of the corner.

The window 63 is defined by vertical studs 74 in parallel with the framing studs 64, and upper and lower framing members 76. A pair of upper and lower support arms 77 each rest upon corner braces 78. A speaker platform 79 is mounted over the lower pair of arms. The window may be equipped with toggle clamps (not shown) for facilitating the interchange of various insert panels for a variety of driver cutouts.

In the remaining corner 22 of the rotatable door 14, further sound absorbing wedges are mounted to provide normal anechoic conditions for full space loading within the chamber 11. To allow for the rotation of the door, the outermost wedges are beveled as at 81.

It may be seen therefore, that an anechoic chamber arrangement has been described which permits the accurate, repeatable testing of corner speakers. In order to do this, the corner 19 is rotated into operable position facing into the chamber 11, and the inflatable hoses 49 are inflated to seal the chamber. A speaker 82 positioned in the corner 19 on the platform 58 provides for accurate testing in an anechoic chamber of a corner speaker in a trihedral corner. Similarly, it may be seen that by positioning the corner 22 in the chamber 11, as shown in FIG. 1, a conventional anechoic chamber is obtained. Other modes of speaker testing are provided by the corners 21 and 23, as discussed above. It may also be seen that speakers, particulary heavy speakers, may be easily positioned in the chamber 11 by loading the speaker into a corner section outside of the chamber, with subsequent rotation of the rotatable door 14 to position the speaker for test.

What is claimd is:

1. An anechoic chamber arrangement for testing different types, or operational modes, of sound generating devices comprising:

an enclosed chamber having a plurality of sound absorbent interior surfaces and including two substantially vertical walls having such interior surfaces extending toward one another at an angle and terminating to define an open corner;

a rotatable door mounted for rotation about a substantially vertical axis at the open corner and having at least three substantially vertical wall vanes meeting to form at least two rotatable corners at said axis, the rotatable door being located such that rotation of the door may position a selected one of said rotatable corners in the open corner with a wall vane extending toward and substantially parallel to each of the two said vertical walls; and means for sealing the space between the enclosed chamber and the door vanes when the wall vanes are aligned with the walls of the chamber, the interior surfaces of one pair of vanes defining a rotatable corner being sound absorbent whereby, when this pair of wall vanes is sealed into position as a corner of the closed chamber, the enclosed chamber serves as a conventional anechoic chamber, the interior surfaces of a second pair of vanes defining a rotatable corner which is enclosed by a substantially flat panel attached to the vanes and lying in a generally vertical plane inwardly toward the interior of the chamber with the panel including means for mounting loudspeakers therein for tests.

2. The anechoic chamber arrangement of claim 1 in which the interior surfaces of another pair of vanes defining a rotatable corner are spanned at a lower portion thereof by a floor to form a trihedral corner suitable for testing corner loudspeakers.

3. The anechoic chamber of claim 1 in which there are four substantially vertical wall vanes meeting to form four rotatable corners and in which the interior surfaces of another pair of vanes defining a rotatable corner provide a substantially unaltered dihedral corner.

4. The anechoic chamber of claim 2 in which there are four substantially vertical wall vanes meeting to form four rotatable corners and in which the interior surfaces of another pair of vanes defining a rotatable corner provide a substantially unaltered dihedral corner.

* * * * *